United States Patent [19]

Büthe

[11] 4,109,352

[45] Aug. 29, 1978

[54] FABRIC CROPPING MACHINE

[75] Inventor: Fritz Büthe, Viersen, Fed. Rep. of Germany

[73] Assignee: Johannes Menschner Textilmaschinenfabrik, Vieren, Fed. Rep. of Germany

[21] Appl. No.: 452,816

[22] Filed: Mar. 20, 1974

[30] Foreign Application Priority Data

Mar. 23, 1973 [DE] Fed. Rep. of Germany ..... 2314557

[51] Int. Cl.[2] ..... D06C 13/00

[52] U.S. Cl. ..... 26/15 R

[58] Field of Search ..... 26/10.4, 15 R, 15 L, 26/15 FB, 17, 18, 29; 83/676

[56] References Cited

U.S. PATENT DOCUMENTS

| | | | |
|---|---|---|---|
| 940,420 | 11/1909 | Ayers et al. | 83/676 |
| 2,225,878 | 12/1940 | Merriman | 26/29 R |
| 3,164,879 | 1/1965 | Sprungli | 26/10.4 |
| 3,513,514 | 5/1970 | Furiness, Jr. et al. | 26/15 R |

FOREIGN PATENT DOCUMENTS

| | | | |
|---|---|---|---|
| 1,177,454 | 9/1964 | Fed. Rep. of Germany | 83/676 |
| 1,290,029 | 2/1969 | Fed. Rep. of Germany | 83/676 |
| 5,960 of | 1830 | United Kingdom | 26/15 R |
| 548,577 | 10/1942 | United Kingdom | 26/15 R |

*Primary Examiner*—Robert R. Mackey
*Attorney, Agent, or Firm*—Michael J. Striker

[57] ABSTRACT

A circular disc is rotated with a cutter means secured to the disc periphery, radially outwardly projecting therefrom, and having cutting edges in a plane normal to the axis of rotation. Means are provided for guiding a fabric into and through a position adjacent said cutter means and in which the fabric extends parallel to said plane of the cutting edges for cutting the nap of the fabric.

2 Claims, 10 Drawing Figures

FABRIC CROPPING MACHINE

BACKGROUND OF THE INVENTION

It has been known to crop or shear the nap of textile fabrics by knives of helical form disposed on cylindrical surfaces and rotating about the axis of the cylinder, in cooperation with a straight counter knife or so-called bottom knife parallel to said axis. In such earlier devices the nap was cut at the points of contact between the helical edges or so-called spirals and the counter knife. The output capacity was dependent on the number of spiral knives on the cylinder, the rotary speed of the cylinder, and the linear speed of the fabric. These parameters controlled the output of the machine and the characteristics of the cropping of the nap of the fabric.

Certain interrelations and limitations have been found in the construction and operation of such machines for cropping the nap of textile fabrics. The number of helical knives which can be provided on a cutting cylinder of given diameter and length is limited, as certain distances must be maintained between the helixes. The peripheral velocity of the cylinder is also limited by a number of factors including the fact that the helical knives act as air blowing fans which produce blowing effects on the nap of the fabric tending to depress this nap and thereby interfering with the proper engagement of the nap by the knives. Difficulties were also encountered since the helical knives were in metal-to-metal contact with the counter knife, except at the points where nap fibers were engaged between the knives. It has been usual to provide the knife edge with a thin lubricant film; however, rapid rotation of the cutting cylinder led to destruction of this film and to consequent rapid wear and tear of the knife edges as well as the development of high temperatures which could even cause burning out of the knife edges.

These difficulties were regrettable, since the economy of cropping or shearing machines depends on the amount of fabric handled by unit of time. If the travelling velocity of the fabrics were increased without regard to the aforementioned problems poor cropping and poor quality of the fabric would result.

Other problems of conventional cropping and shearing machines will be noted hereinafter.

SUMMARY OF THE INVENTION

It is an object of the invention to avoid the former limitations and drawbacks.

It is a further object to provide a machine which can crop or shear fabrics more rapidly than has been possible up to now, and at the same time to provide desirably high quality of the sheared fabric.

It is a further object to provide the new machine in simple form so that it requires only a minimum of service.

The objects are achieved by the use of a rotating circular disc with cutter means radially outwardly projecting therefrom and having cutting edges in a plane normal to the axis of rotation of the disc, in combination with means for guiding a fabric into and through a position adjacent said cutter means in which the fabric extends parallel to the plane of the cutting edges.

This new arrangement differs basically from the cropping or shearing machines which have been used for cutting the nap of fabrics in the past. For one thing, the new arrangement does not require or use a counter knife or bottom knife. Thereby it allows shearing the nap down to the point that totally bald fabric is produced, which heretofore was impossible since the thickness of the counter-knife limited the extent of cropping of the nap. Furthermore, the new arrangement substantially improves the quality of the sheared fabric since it no longer applies bending effects to the nap threads; rather the nap arrives at the cutting edges of the new machine in perfectly upstanding position and can be cut without the irregularities which heretofore were caused by the presence of the bottom knife.

The new machine is capable of higher output than the earlier ones as it no longer requires limitation of the peripheral speed of the cutting edges or limitation of the linear speed of the fabric. It also avoids the serious difficulties heretofore encountered by the metal-to-metal contact between the cutting edges and the consequent wear and tear of those edges. Lubrication of the cutting edges is no longer needed. Also, in contrast to the former, helical knives, the new knife edge arrangement produces uninterrupted cutting action. Heretofore as mentioned helical knife edges had to be placed at certain distances from one another and therefore could be provided only in limited numbers on a given length of the cutting cylinder; by contrast the new cutter disc provides the equivalent of an infinite number of helical cutting edges.

Difficulties of the former knife cylinder machines were connected with the making and use of knives with edges moving in cylindrical paths. For one thing, these edges were quite difficult and expensive to produce, in comparison with the much simpler knife edges of the new machine, which lie in a flat plane. The former, cylindrically moving knives caused air blowing effects by their side surfaces, as already mentioned; they also caused long fibers of nap to be wrapped around the cylinder or to be cut improperly for other reasons. The new substantially planar cutters are free of these difficulties.

The quantities of fabrics which can be treated by the new machine are far in excess of the quantities obtainable with conventional machines. At the same time, the quality of the cropping effect is excellent. As already noted, the cropping can be brought to the point of bald shearing of the fabric.

The output achievable by the new machine can be increased further in certain preferred forms of the invention, by guiding fabrics into positions parallel to the cutter plane, at more than one sector of the rotating disc. Each fabric table cooperating with a cutter disc according to the invention can have its own freely adjustable level control, for individual control over the height of cropping. It is also possible to crop both sides of a fabric on a single disc according to the invention, by combining the disc with a fabric turning structure.

The cropper disc can be disposed horizontally, vertically or under any desired angle. The cutters of the new machine can be provided in the form of a single cutting ring, or in the form of a plurality of cutting segments. Such segments can also have the forms of sickles, sawteeth and the like. The fabric guiding means or tables can have various forms, known by themselves, such as the form of a straight or curved edge; a pair of edges or supports between which the fabric moves without other mechanical support; and roller means instead of such edges for guiding the fabric.

A hood can be provided adjacent the nap cutting area, for promoting proper upright orientation of the nap fibers and for prompt removal of cut off nap fibers.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
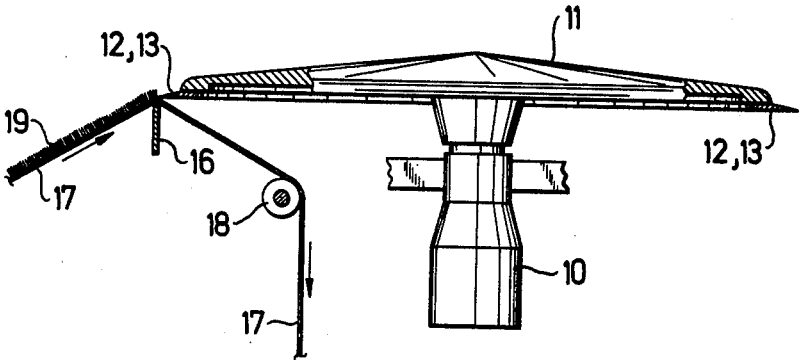
FIG. 1 is a side view partly in section of a first embodiment of the invention.
Figure 2:
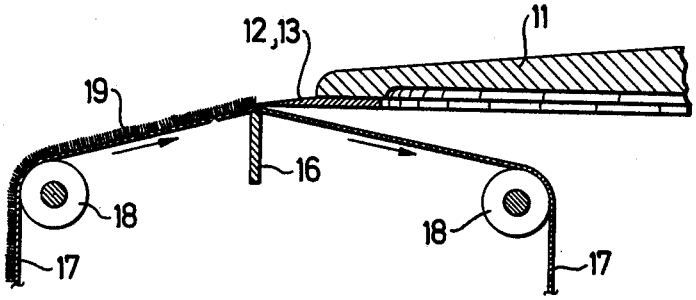
FIG. 2 is a detail from FIG. 1 drawn on a larger scale.
Figure 6:
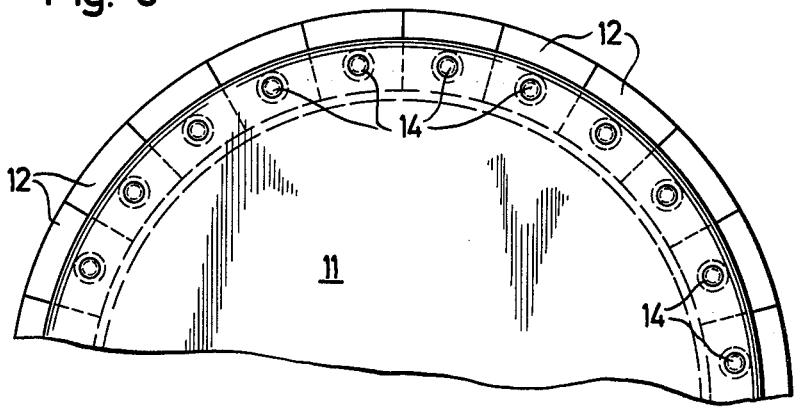
FIG. 6 shows a disc with a first form of cutters.
Figure 7:
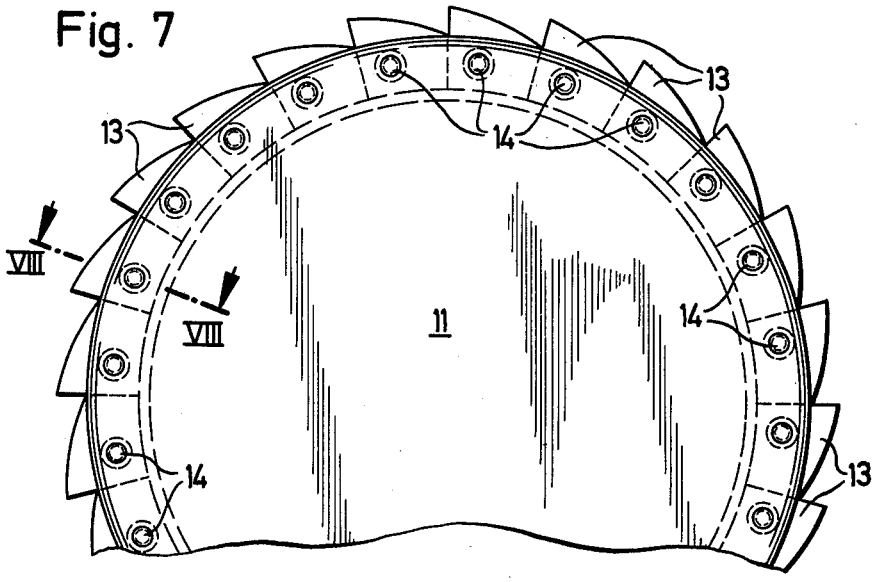
FIG. 7 shows a disc with a second form of cutters.
Figure 8:
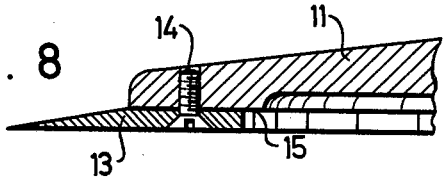
FIG. 8 is a cross section taken along the line VIII—VIII of FIG. 7.

The machine is shown in FIGS. 1 and 2 as having a vertical bearing 10 for axial support of cutter wheel 11. This wheel has the form of a circular disc rotating in a horizontal plane. Drive means, not shown, rapidly drive the wheel or disc 11. Such drive means may be constituted by an electric motor which preferably includes means known in the art for regulating the speed of the motor. At the periphery of this disc, cutters 12, 13 are provided. These cutters can have arcuate edges, concentric with wheel 11, as shown in FIG. 6, or can be formed as sickle shaped or sawtooth shaped cutters 13 as shown in FIG. 7. As shown in FIG. 8, the cutters can be attached by bolts 14 to a planar cutter mounting surface 15 on the periphery of the cutter wheel. By means of these arrangements it is possible to replace individual cutters rapidly.

A bar 16 is provided at right angles to the plane of rotation of the cutting wheel 11, and with a horizontal edge of the bar supporting fabric 17 adjacent cutters 12, 13, in a position in which a portion of the fabric extends parallel to the plane of rotation of these cutters. Rollers 18 guide fabric 17 to and from the edge of the bar 16. The direction of transport of fabric 17 is indicated by arrows. Dependent on the exact vertical distance between the horizontal plane in which the cutting edges rotate and the plane in which the fabric is held by bar 16, the nap 19 on the fabric can be cut to predetermined extent, down to bald cutting of the fabric as indicated.

Instead of rotating disc 11 in a horizontal plane, this disc can be rotated in an inclined or vertical plane. In the latter event the fabric support 16, 17, 18 can be kept in the same arrangement, relative to the disc, as is shown in FIG. 1; it is only necessary to tilt the entire FIG. 1 as may be preferred.

Figure 3:
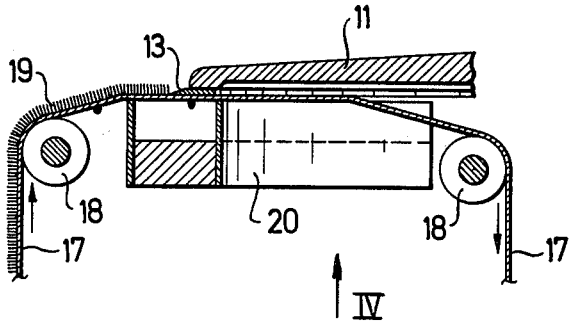
FIG. 3 is a view generally corresponding to FIG. 1 but showing a second embodiment.
Figure 4:
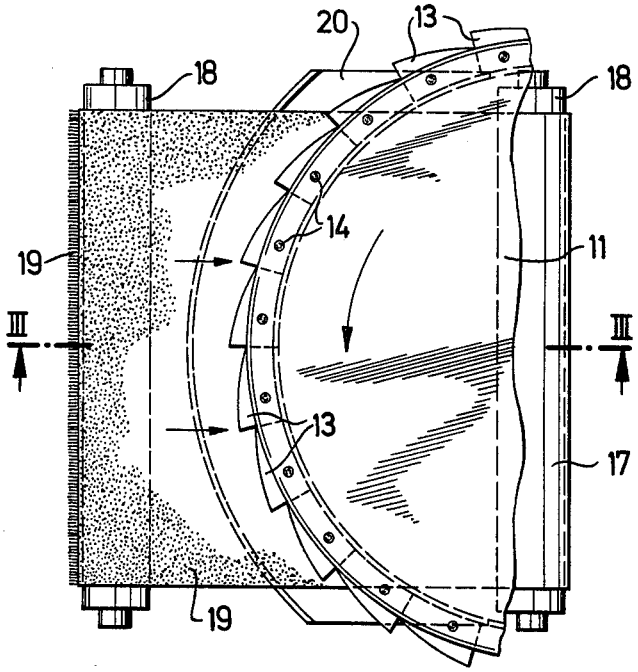
FIG. 4 is a plan view of the apparatus of FIG. 3.

In the embodiments of FIGS. 3 and 4, fabric 17 is guided to cutters 13 across a hollow space in support device 20, between two support bars upstanding from this device. Here as in FIGS. 1 and 2, the fabric support device can be of arcuate shape, as best shown in FIG. 4. It can extend below a sector of cutter wheel 11, the angular extent of which depends on the width of the fabric 17 to be treated. It will be seen that in FIGS. 3 and 4, and also in the other embodiments, the fabric portion being cut at any given moment is composed of two halves located to either side of a radius of the cutter wheel 11 which extends parallel to the direction of travel of such fabric portion.

The use of a hollow support 20, according to FIGS. 3 and 4, has the advantage that it easily avoids impairment of the cropping or shearing effect by the possible presence of knots or bulges, indicated by small black dots on the underside of fabric 17 in FIG. 3.

Figure 5:
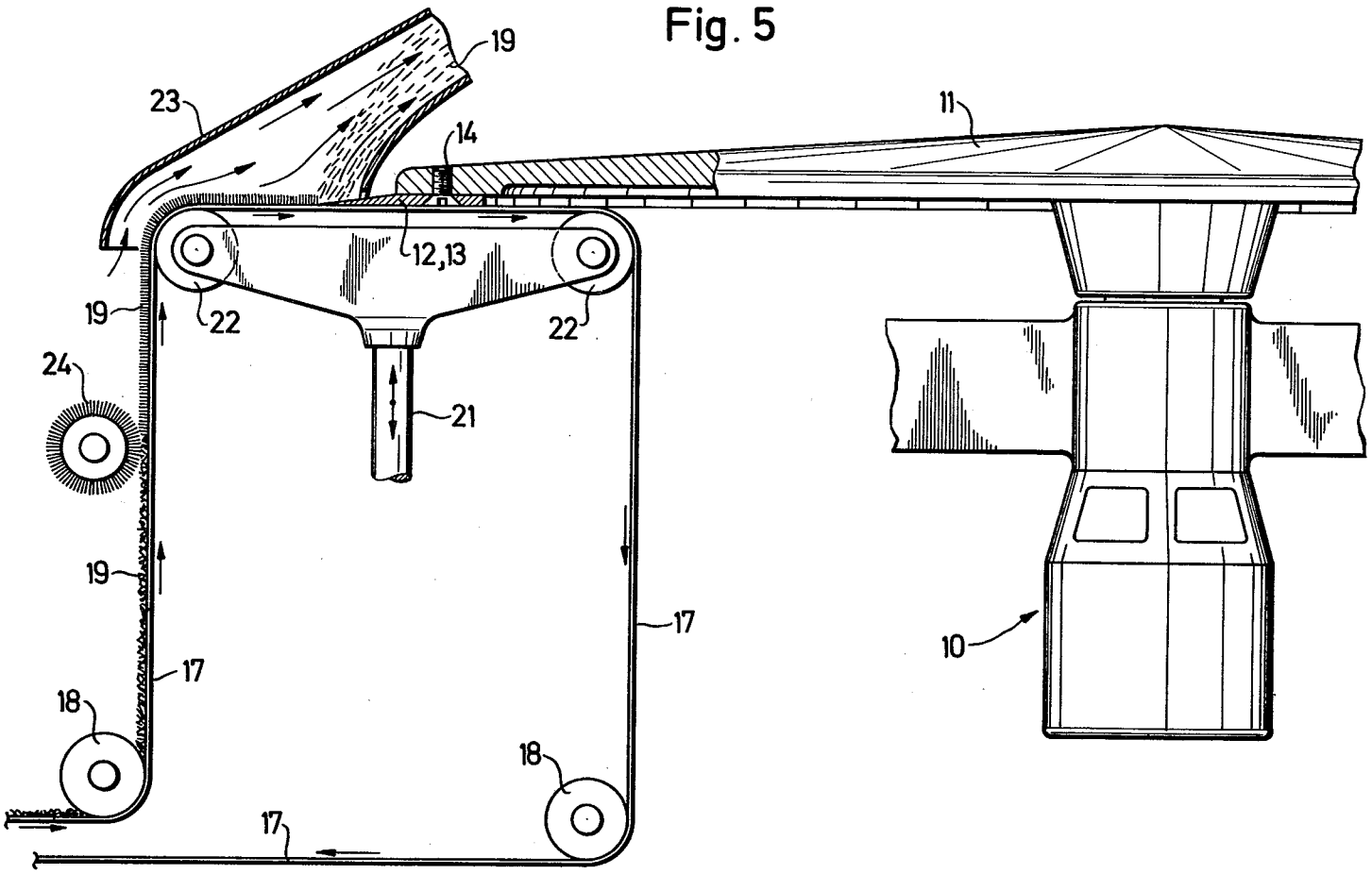
FIG. 5 is a view generally corresponding to FIG. 2, but showing a third embodiment of the invention.

In the embodiment of FIG. 5, the fabric is guided into engagement with cutters 12, 13 across a hollow space formed by a pair of rollers 22 pivoted in a bracket which can be raised and lowered relative to disc 11 by suitable support post means 21.

This Figure also shows hood 23 superimposed over the fabric adjacent the cutters 12, 13. By means of a suitable suction device, not shown, low pressure can be maintained in hood 23, for the purpose of not only removing cut fibers but also making sure that nap 19 reaches the cutting edges in upstanding position. The device also serves to assure cutting and removal of loose edge threads.

Figure 9:
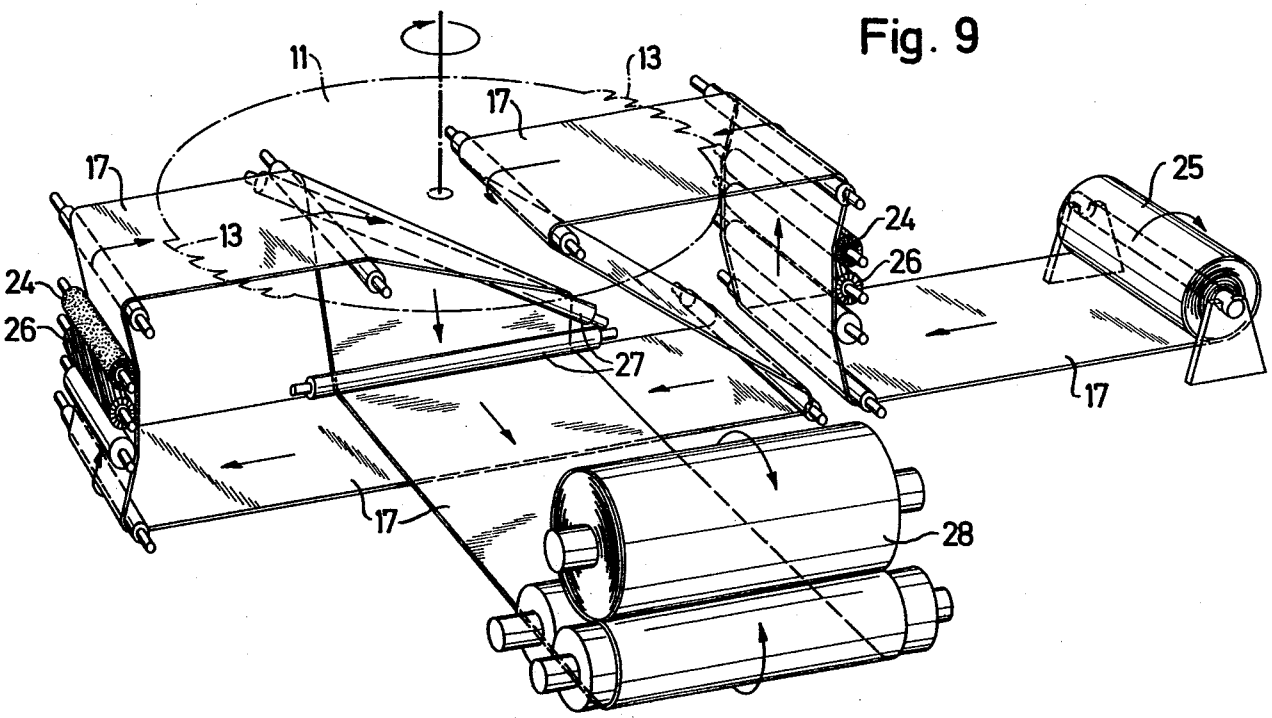
FIG. 9 is a schematic perspective view of a fourth embodiment of the invention showing a fabric reversing arrangement.

In the embodiment of FIG. 9, cutter wheel 11 is shown only schematically. The fabric is supplied by a beam or roll 25. One surface of the fabric supported by rollers as in FIG. 5 is treated by brushes or carding wheels 24 (also shown in FIG. 5). These are aided, if desired, by rollers 26 for additional surface treatment. The treated surface then has its nap cropped by cutter wheel 11. Thereupon fabric 17 is guided around further rollers, parallel to the aforementioned ones, as is shown by leftward arrows below wheel 11, so as to turn fabric 17 and to present the other surface of this same fabric 17 to another segmental area of the same cutter wheel 11 for cutting nap on this other surface. Finally, the fabric can be withdrawn laterally over still further rollers 27 and can be wound in form of a finished fabric roll 28.

Figure 10:
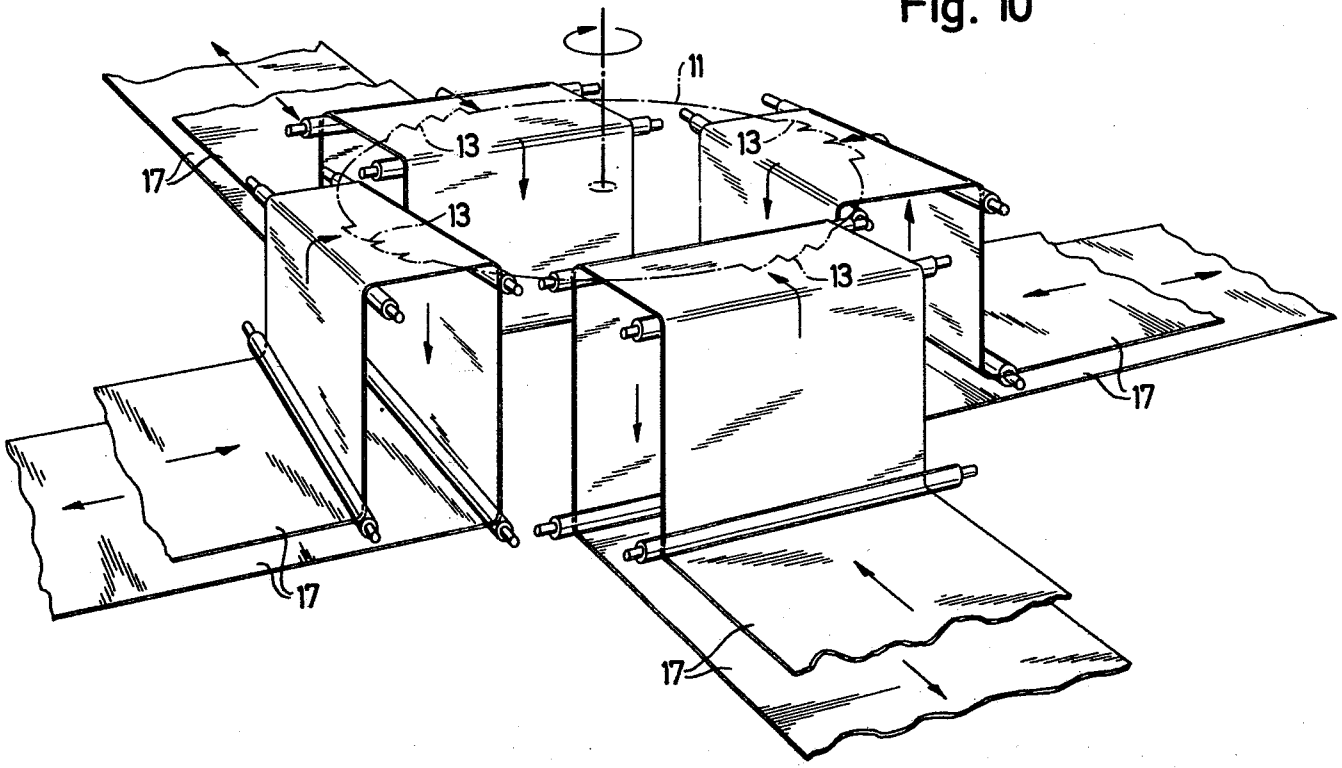
FIG. 10 is a similar view of a fifth embodiment of the invention and showing a plurality of fabric guide means cooperating with a single cutting disc.

A fifth and final embodiment of the invention is shown in FIG. 10. Again the cutting wheel 11 is shown diagrammatically. Four different fabrics 17 are supported, respectively below first, second, third and fourth sectors of wheel 11, each fabric being guided by rollers similar to those shown in FIG. 5, directly below the wheel, and by additional, parallel rollers at lower elevations as shown. The four sectors of wheel 11 are disposed at 90° to one another. Thus it becomes possible to additionally speed up the production achieved with the new device. Each fabric 17 can be individually adjusted relative to the plane of rotation of wheel 11, for individual control of the height of cropping.

It will be understood that each of the elements described above, or two or more together, may also find useful applications in other types of fabric cropping machines differeing from the types described above.

While the invention has been illustrated and described as embodied in a fabric cropping machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended with the meaning and range of equivalence of the following claims.

What is claimed as new and desired to be protected by Letters Patent is set forth in the appended claims.

I claim:

1. A machine for cropping or shearing nap of fabrics, comprising a circular disc; means for rotating said disc about the axis of said disc; cutter means secured to the periphery of said disc, radially outwardly projecting therefrom, and having a cutting edge in a plane normal to said axis; and means for guiding an elongated fabric in direction transverse to the width of the elongated fabric along a predetermined path of travel so oriented that the fabric moves into and through a position directly opposed to and beneath said cutting edge of said cutter means in which a portion of the fabric extends parallel to said plane of said cutting edge and in which the cutting edge cuts through the fabric nap across the full width of the fabric, said predetermined path of travel and said plane of said cutting edge being furthermore so oriented relative to each other that an elongated fabric being guided along said path by means for guiding as it passes through said position is generally horizontally disposed with the fabric portion occupying said position being unsupported from below, whereby the presence of knots or bulges on the side of the fabric opposite the side facing the cutting edge will not interfere with the travel of the fabric through said position.

2. A machine as defined in claim 1 wherein said means for guiding said elongated fabric comprises a pair of bars disposed at right angles to said plane of the cutting edge, one of said bars being disposed at a radial distance from said axis greater than that of said cutting edge, the other bar being disposed at a radial distance smaller than that of said cutting edge, from said axis of said disc, each of said bars having an edge located in a plane adjacent and substantially parallel to said plane of said cutting edge.

* * * * *